US009926636B2

(12) United States Patent
Doughty

(10) Patent No.: US 9,926,636 B2
(45) Date of Patent: Mar. 27, 2018

(54) METHOD AND APPARATUS FOR PRODUCING METAL BY ELECTROLYTIC REDUCTION

(71) Applicant: METALYSIS LIMITED, Rotherham (GB)

(72) Inventor: Greg Doughty, Rotherham (GB)

(73) Assignee: METALYSIS LIMITED (GB)

( * ) Notice: Subject to any disclaimer, the term of this patent is extended or adjusted under 35 U.S.C. 154(b) by 190 days.

(21) Appl. No.: 14/655,012

(22) PCT Filed: Dec. 20, 2013

(86) PCT No.: PCT/EP2013/077855
§ 371 (c)(1),
(2) Date: Jun. 23, 2015

(87) PCT Pub. No.: WO2014/102223
PCT Pub. Date: Jul. 3, 2014

(65) Prior Publication Data

US 2016/0194773 A1 Jul. 7, 2016

(30) Foreign Application Priority Data

Dec. 24, 2012 (GB) ..... 1223375.5

(51) Int. Cl.
*C25C 3/26* (2006.01)
*C25C 3/00* (2006.01)
*C25C 7/02* (2006.01)

(52) U.S. Cl.
CPC ..... *C25C 3/26* (2013.01); *C25C 3/00* (2013.01); *C25C 7/025* (2013.01)

(58) Field of Classification Search
None
See application file for complete search history.

(56) References Cited

U.S. PATENT DOCUMENTS 3,578,580 A * 5/1971 Schmidt-Hatting et al. ..... C25C 3/06 204/243.1
5,754,392 A 5/1998 Cava
(Continued)

FOREIGN PATENT DOCUMENTS

CN 1982506 6/2007
CN 100457931 2/2009
(Continued)

OTHER PUBLICATIONS

"Influence of Oxygen in Copper", Continuus Properzi, no date provided obtained at http://www.properzi.com/literature/category/4-copper-rod-and-wire?download=11:influence-of-oxygen-in-copper on Apr. 25, 2017.*
(Continued)

*Primary Examiner* — Harry D Wilkins, III
(74) *Attorney, Agent, or Firm* — Saliwanchik, Lloyd & Eisenschenk

(57) ABSTRACT

A method is provided for producing metal by electrolytic reduction of a feedstock comprising an oxide of a first metal. The method comprises the steps of arranging the feedstock in contact with a cathode and a molten salt within an electrolysis cell, arranging an anode in contact with the molten salt within the electrolysis cell, and applying a potential between the anode and the cathode such that oxygen is removed from the feedstock. The anode comprises a second metal, which at the temperature of electrolysis within the cell is a molten metal. The second metal is a different metal to the first metal. Oxygen removed from the feedstock during electrolysis reacts with the molten second metal to form an oxide comprising the second metal. Thus, oxygen is not evolved as a gas at the molten anode.

21 Claims, 1 Drawing Sheet

(56) References Cited

U.S. PATENT DOCUMENTS

Figure 1:
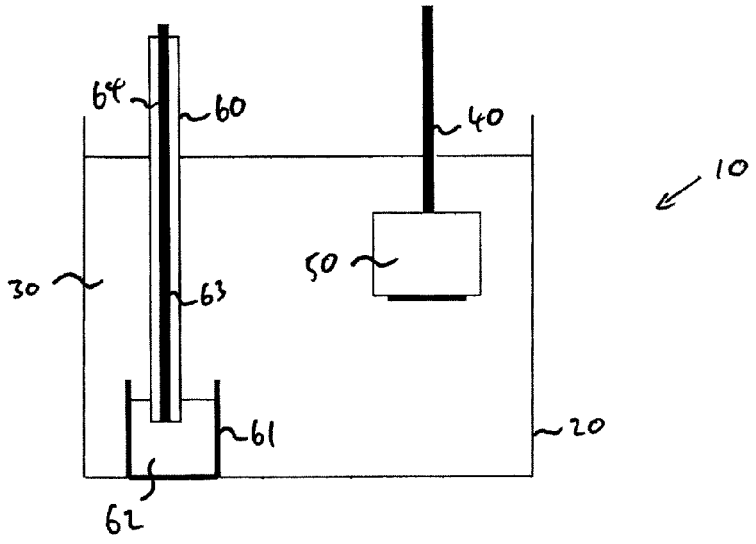

| | | | | |
|---|---|---|---|---|
| 6,299,742 | B1 * | 10/2001 | Pal | C25C 3/00 204/243.1 |
| 2005/0121333 | A1 * | 6/2005 | Strezov | C25C 3/28 205/398 |
| 2006/0086621 | A1 * | 4/2006 | Fray | C22B 5/04 205/357 |
| 2013/0186769 | A1 * | 7/2013 | Powell | C25C 1/00 205/343 |

FOREIGN PATENT DOCUMENTS

| | | | | |
|---|---|---|---|---|
| CN | 101501798 | | 8/2009 | |
| CN | 102317012 | | 1/2012 | |
| CN | 102864468 | | 1/2013 | |
| JP | 2012-136766 | | 7/2012 | |
| WO | WO 99/64638 | A1 * | 12/1999 | C25C 3/28 |
| WO | WO 02/083993 | | 10/2002 | |
| WO | WO 03/048399 | | 6/2003 | |
| WO | WO 2008/007126 | | 1/2008 | |
| WO | WO 2010/092358 | | 8/2010 | |
| WO | WO 2013/028126 | | 2/2013 | |
| WO | WO 2013/028798 | | 2/2013 | |

OTHER PUBLICATIONS

Hoar, TP and Ward, RG "The Production of Copper and Sulphur by the Electro-Decomposition of Cuprous Sulphide" *Institution of Mining and Metallurgy*, 1958, pp. 393-410.

Sharma, RA and Seefurth, RN "A Molten Salt Process for Producing Neodymium and Neodymium-Iron Alloys" *Metallurgical Transactions B*, Dec. 1989, vol. 20B, pp. 805-813.

* cited by examiner

METHOD AND APPARATUS FOR PRODUCING METAL BY ELECTROLYTIC REDUCTION

CROSS-REFERENCE TO RELATED APPLICATION

This application is the National Stage of International Application No. PCT/EP2013/077855, filed Dec. 20, 2013, which is hereby incorporated by reference herein in its entirety, including any figures, tables, nucleic acid sequences, amino acid sequences, or drawings.

The invention relates to a method and apparatus for producing metal by electrolytic reduction of a feedstock comprising an oxide of a first metal.

BACKGROUND

The present invention concerns a method for the production of metal by reduction of a feedstock comprising an oxide of a metal. As is known from the prior art, electrolytic processes may be used, for example, to reduce metal compounds or semi-metal compounds to metals, semi-metals, or partially-reduced compounds, or to reduce mixtures of metal compounds to form alloys. In order to avoid repetition, unless otherwise indicated the term metal will be used in this document to encompass all such products, such as metals, semi-metals, alloys, intermetallics. The skilled person will appreciate that the term metal may, where appropriate, also include partially reduced products.

In recent years, there has been great interest in the direct production of metal by direct reduction of a solid metal oxide feedstock. One such direct reduction process is the Cambridge FFC® electro-decomposition process, as described in WO 99/64638. In the FFC process, a solid compound, for example a metal oxide, is arranged in contact with a cathode in an electrolysis cell comprising a fused salt. A potential is applied between the cathode and an anode of the cell such that the compound is reduced. In the FFC process, the potential that produces the solid compound is lower than a deposition potential for a cation from the fused salt.

Other reduction processes for reducing feedstock in the form of a cathodically connected solid metal compound have been proposed, such as the Polar® process described in WO 03/076690 and the process described in WO 03/048399.

Typical implementations of direct reduction processes conventionally use carbon-based anode materials. During the reduction process the carbon-based anode materials are consumed and the anodic product is an oxide of carbon, for example gaseous carbon monoxide or carbon dioxide. The presence of carbon in the process leads to a number of issues that reduce the efficiency of the process and lead to contamination of the metal produced by reduction at the cathode. For many products it may be desirable to eliminate carbon from the system altogether.

Numerous attempts have been made to identify so-called inert anodes that are not consumed during electrolysis and evolve oxygen gas as an anodic product. Of conventional, readily-available materials, tin oxide has shown some limited success. A more exotic oxygen-evolving anode material based on calcium ruthenate has been proposed, but the material has limited mechanical strength, suffers from degradation during handling, and is expensive.

Platinum has been used as an anode in LiCl-based salts for the reduction of uranium oxide and other metal oxides, but the process conditions need to be very carefully controlled to avoid degradation of the anode and this too is expensive. Platinum anodes are not an economically viable solution for an industrial scale metal production process.

While an oxygen-evolving anode for use in the FFC process may be desirable, the actual implementation of a commercially viable material appears to be difficult to achieve. Furthermore, additional engineering difficulties may be created in the use of an oxygen-evolving anode, due to the highly corrosive nature of oxygen at the high temperatures involved in direct electrolytic reduction processes.

An alternative anode system is proposed in WO 02/083993 in which the anode in an electrolysis cell was formed from molten silver or molten copper. In the method disclosed in WO 02/083993 oxygen removed from a metal oxide at the cathode is transported through the electrolyte and dissolves in the metal anode. The dissolved oxygen is then continuously removed by locally reducing oxygen partial pressure over a portion of the metal anode. This alternative anode system has limited use. The removal of oxygen is dependent on the rate at which the oxygen can diffuse into the molten silver or copper anode material. Furthermore, the rate is also dependent on the continuous removal of oxygen by locally reducing partial pressure over a portion of the anode. Thus, this process does not appear to be a commercially viable method of producing metal.

SUMMARY OF THE INVENTION

The invention provides a method and apparatus for producing metal by electrolytic reduction of a feedstock comprising a metallic oxide as defined in the appended independent claims. Preferred and/or advantageous features of the invention are set out in various dependent sub-claims.

In the first aspect a method for producing metal by electrolytic reduction of a feedstock comprising an oxide of a first metal and oxygen may comprise the steps of arranging the feedstock in contact with a cathode and a molten salt within an electrolysis cell, arranging an anode in contact with the molten salt within the electrolysis cell, and applying a potential between the anode and the cathode such that oxygen is removed from the feedstock. The anode comprises a molten metal, which is a different metal to the first metal comprised in the feedstock. The molten metal may be referred to as a second metal. While the second metal may not be molten at room temperature it is molten at the temperature of electrolysis within the cell, when the potential is applied between the anode and the cathode. Oxygen removed from the feedstock is transported through the salt to the anode where it reacts with the molten metal of the anode to form an oxide comprising the molten anode metal and oxygen.

The feedstock may be in the form of powder or particles of an oxide or may be in the form of preformed shapes or granules formed from a powdered metallic oxide. The feedstock may comprise more than one oxide, i.e. oxides of more than one metallic species. The feedstock may comprise complex oxides having multiple metallic species. The feedstock may simply comprise a metal oxide such as titanium dioxide or tantalum pentoxide.

A key difference between the invention described in this aspect and the prior art disclosure of WO 02/083993 is that the molten anode metal of the present invention is consumed during the electrolysis process. In other words, the molten anode metal must be a metal that readily oxidises on contact with an oxygen species in order to form an oxide comprising the second metal and oxygen.

Oxides formed at the anode during electrolysis may be in the form of particles which may sink into the molten metal exposing more molten metal for oxidation. The oxide formed at the anode may form particles that disperse into the molten salt and expose more molten metal for subsequent oxidation. The oxide formed at the anode may form as a liquid phase dissolved within the metal. The oxide can form rapidly at the surface of the molten anode, and can disperse away from the surface of the molten anode. Thus, formation of the oxide does not provide a significant kinetic inhibition on the oxidation reaction. By contrast the dissolution of oxygen into the molten metal anode of WO 02/083993 is dependent on solubility of oxygen in the molten metal anode, the diffusion of oxygen into the molten anode, and the transport of oxygen out of the anode under a reduced partial pressure.

Since the molten metal anode does not evolve oxygen gas, in contrast to inert anodes, the potential for oxidation of the cell materials of construction is removed. For example, when employing "standard" inert anodes, exotic materials would need to be selected for construction of the cell that are able to withstand oxygen at elevated temperatures.

The use of a carbon anode would result in CO and $CO_2$ evolution. Both CO and $CO_2$ are oxidising agents, but to a lesser extent than oxygen, and can attack the materials of construction. This may result in corrosion products entering the melt and consequently the product.

It is preferred that the second metal at the anode is at a temperature close to, and just above, its melting point during operation of the apparatus in order to reduce losses of the anode material by excessive vaporisation.

During operation of apparatus, a proportion of the second metal from the anode is likely to deposit at the cathode, where it may deposit on or interact with the reduced feedstock. Thus, the reduced feedstock may comprise both the first metal, i.e. the metal of the metal oxide in the feedstock, and additionally a proportion of the second metal.

It may be desirable that the method comprises a further step of separating the second metal from the reduced feedstock to provide a product that comprises the first metal but not the second metal. Such separations may conveniently be carried out by thermal processes such as thermal distillation. For example, if the boiling point of the first metal is considerably higher than the boiling point of the second metal, then the reduced product comprising the first metal and the second metal may be heated in order to evaporate the second metal. The evaporated second metal may be condensed to recover the second metal and replenish the anode material.

The second metal may be removed from the first metal by a process such as treatment in an acid wash. The appropriateness of this method will depend on the relative properties of the first metal and the second metal, and whether the second metal is susceptible to dissolution in certain solutions, for example acid solutions, and the first metal is not.

If the second metal is to be separated from the first metal, it is desirable that the second metal is a metal that does not form a highly stable alloy or intermetallic with the first metal. If the first metal and the second metal do form an alloy or intermetallic, it is preferred that the alloy or intermetallic is not stable above the boiling point of the second metal, allowing the second metal to be removed by thermal treatment. Such information may be readily obtained by the skilled person on consulting phase diagrams. For example, if the feedstock comprises titanium oxide and the molten anode is formed from molten zinc, then the reduced feedstock will comprise titanium with a proportion of zinc. Zinc does form an alloy with titanium at low zinc concentrations and can also form intermetallic compounds. However, since zinc has a boiling point of 905° C., and the alloys and intermetallics are not stable at this temperature, the zinc can be removed from the reduced feedstock by heating the reduced feedstock above 905° C. and vaporising the zinc. By using an apparatus in which the second metal is a metal that can be easily removed, such as zinc, the contamination of the reduced product at the cathode may be described as transient contamination.

The second metal, i.e. the anode metal, may be a commercially pure metal. Alternatively, the second metal may be an alloy of two or more elements, for example an alloy of eutectic composition. It may be desirable to have an alloy of eutectic composition in order to lower the melting point of the anode metal and thereby operate the process at a more favourable lower temperature.

Preferably, the second metal has a melting point of less than 1000° C., such that it is molten at temperatures under which the electrolysis process is likely to be performed, and a boiling point of less than 1500° C. to enable the second metal to be removed from the first metal by thermal treatment. It may be particularly preferred if the melting point is less than 600° C. and the boiling point is less than 1000° C.

The second metal may preferably be a metal or alloy of any metal selected from the list consisting of zinc, tellurium, bismuth, lead, and magnesium.

It is particularly preferred that the second metal is zinc or a zinc alloy. Zinc is a relatively low cost material and is relatively harmless in comparison to many other metals.

The first metal is a different metal or alloy to the second metal. Preferably the first metal is, or is an alloy of, any metal selected from the list consisting of silicon, scandium, titanium, vanadium, chromium, manganese, iron, cobalt, nickel, germanium, yttrium, zirconium, niobium, molybdenum, uranium, actinides, hafnium, tantalum, tungsten, lanthanum, cerium, praseodymium, neodymium, and samarium.

The skilled person will be able to select a feedstock comprising any first metal listed above and an anode comprising any second metal listed above.

It may be desirable that the molten salt is at a temperature below 1000° C. when the potential is applied between the cathode and the anode. It may be particularly preferable to have the temperature of the molten salt during the process as low as possible in order to minimise the vapour pressure above the molten anode and thus the loss of the molten anode material. Thus, it may be preferable that the molten salt is maintained at a temperature of lower than 850° C., for example lower than 800° C. or 750° C. or 700° C. or 650° C., during electrolysis.

Any salt suitable for use in the electrolysis process may be used. Commonly used salts in the FFC process include calcium chloride containing salts. Due to the desirability of low temperature operation, it may be particularly desirable that the molten salt is a lithium-bearing salt, for example preferably a salt comprising lithium chloride. The salt may comprise lithium chloride and lithium oxide.

The second metal in the anode is consumed during the process due to the formation of an oxide between the second metal and oxygen. The method may advantageously comprise the further step of reducing the oxide formed at the anode, i.e. the oxide comprising the second metal and oxygen, in order to recover and re-use the second metal. The step of further reducing the oxide may take place after the electrolysis reaction has completed. For example, the oxide formed may be taken and reduced by carbothermic reduction or by standard FFC reduction. The recovered second metal may be returned to the anode.

The step of reducing the oxide comprising the second metal and oxygen may involve a system in which molten material at the anode is constantly pumped from the anode to a separate cell or chamber where it is reduced to recover the second metal, which is then transferred back to the anode. Such a system may allow a reduction cell to be operated for a long period of time, or a continuous period of time, as the anode material is constantly replenished as it is being consumed.

It is particularly preferred that the anode comprises molten zinc. Zinc melts at around 420° C. and boils at 905° C. and, advantageously, is a metal that does not react strongly with many commercially desirable metals such as titanium and tantalum. The low boiling point of zinc means that any zinc contamination of the reduced product may be dealt with by heat treatment of the reduced product to evaporate any zinc.

Zinc oxide produced at the anode can be easily converted back to zinc by reaction with carbon.

A further particularly preferred anode material may be tellurium. A still further preferred anode material may be magnesium, although there are hazards associated with this metal due to its high reactivity.

In preferred embodiments the feedstock may comprise a tantalum oxide and the anode comprises molten zinc, the reduced product being tantalum metal contaminated with zinc. The contamination of the reduced product with zinc may be corrected by heat treating the reduced product leaving tantalum metal.

In preferred embodiments the feedstock may comprise a titanium oxide and the anode comprises molten zinc. The product will thus be titanium.

The reaction of the oxygen removed from the feedstock with the anode material to form an oxide means that there is no evolution of oxygen within the cell. This may have significant engineering benefits, as the necessity to deal with high temperature oxygen off gases is negated.

As there is no carbon required for the electrolysis reaction to proceed, the product of the process, i.e. the reduced feedstock, has little to no carbon contamination. Although carbon contamination may not be an issue in the direct electrolytic reduction of some metals, for other applications and metals any level of carbon contamination is undesirable. The use of this method allows a direct reduction of an oxide material to metal at a commercially viable rate while eliminating carbon contamination. Furthermore, although the anode material is consumed during the electrolysis, it is simple to recover the oxide resulting from this consumption, reduce this oxide, and re-use the anode material.

In a second aspect, an apparatus for producing metal by electrolytic reduction of feedstock comprising a metal oxide of a first metal and oxygen comprises a cathode and an anode arranged in contact with a molten salt, the cathode being in contact with the feedstock and the anode comprising a molten metal. The molten metal is a metal capable of forming an oxide.

Preferably, the molten metal is, or is an alloy of, any metal selected from the list consisting of zinc, tellurium, bismuth, lead, indium, and magnesium.

SPECIFIC EMBODIMENTS OF THE INVENTION

Figure 2:
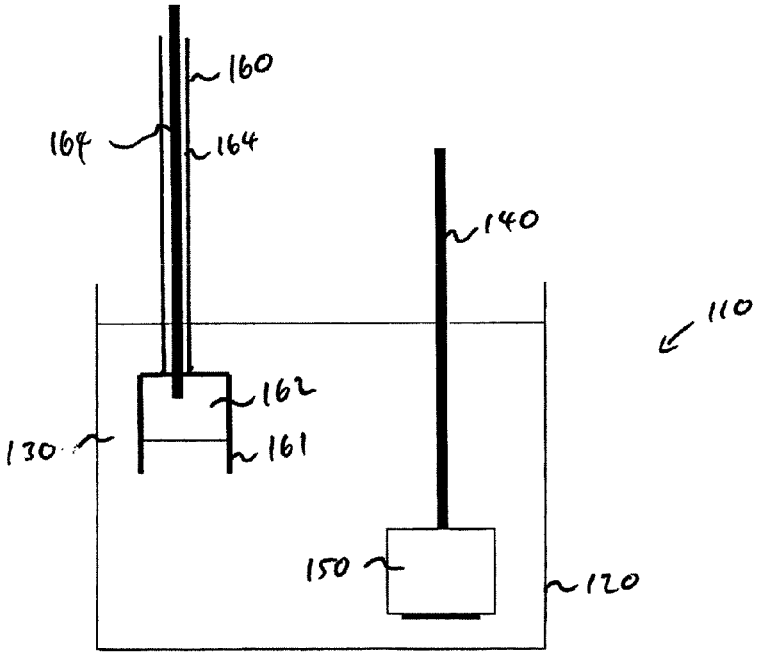

Specific embodiments of the invention will now be described with reference to the figures, in which FIG. 1 is schematic diagram illustrating an apparatus according to one or more aspects of the invention; and FIG. 2 is a schematic diagram of a second embodiment of an apparatus according to one or more aspects of the invention.

FIG. 1 illustrates an electrolysis apparatus 10 for producing metal by electrolytic reduction of an oxide feedstock. The apparatus 10 comprises a crucible 20 containing a molten salt 30. A cathode 40 comprising a pellet of metal oxide 50 is arranged in the molten salt 30. An anode 60 is also arranged in the molten salt. The anode comprises a crucible 61 containing a molten metal 62, and an anode connecting rod 63 arranged in contact with the molten salt 62 at one end and coupled to a power supply at the other. The anode connecting rod 63 is sheathed with an insulating sheath 64 so that the connecting rod 63 does not contact the molten salt 30.

The crucible 20 may be made from any suitable insulating refractory material. It is an aim of the invention to avoid contamination with carbon, therefore the crucible is not made from a carbon material. A suitable crucible material may be alumina. The metal oxide 50 may be any suitable metal oxide. A number of metal oxides have been reduced using direct electrolytic processes such as the FFC process and are known in the prior art. The metal oxide 50 may be, for example, a pellet of titanium dioxide or tantalum pentoxide. The crucible 61 containing the molten metal 62 may be any suitable material, but again alumina may be a preferred material. The anode lead rod 63 may be shielded by any suitable insulating material 64, and alumina may be a suitable refractory material for this purpose.

The molten metal 62 is any suitable metal that is liquid in the molten salt at the temperature of operation. To be a suitable molten metal, the molten metal 62 must be capable of reacting with oxygen ions removed from the metal oxide to create an oxide of the molten metal species. A particularly preferable molten metal may be zinc. The molten salt 30 may be any suitable molten salt used for electrolytic reduction. For example, the salt may be a chloride salt, for example, a calcium chloride salt comprising a portion of calcium oxide. Preferred embodiments of the invention may use a lithium based salt such as lithium chloride or lithium chloride comprising a proportion of lithium oxide. The anode 60 and cathode 40 are connected to a power supply to enable a potential to be applied between the cathode 40 and its associated metal oxide 50 on the one hand and the anode 60 and its associated molten metal 62 on the other.

The arrangement of the apparatus illustrated in FIG. 1 assumes that the molten metal 62 is more dense than the molten salt 30. This arrangement may be suitable, for example, where the salt is a lithium chloride salt and the molten metal is molten zinc. In some circumstances, however, the molten metal may be less dense than the molten salt used for the reduction. In such a case an apparatus arrangement as illustrated in FIG. 2 may be appropriate.

FIG. 2 illustrates an alternative apparatus for producing metal by electrolytic reduction of an oxide feedstock. The apparatus 110 comprises a crucible 120 containing a molten salt 130, a cathode 140 comprises a pellet of metal oxide 150 and the cathode 140 and the pellet of metal oxide 150 are arranged in contact with the molten salt 130. An anode 160 is also arranged in contact with the molten salt 130 and comprises a metallic anode connecting rod 163 sheathed by an insulating material 164. One end of the anode 160 is coupled to a power supply and the other end of the anode is in contact with a molten salt 162 contained within a crucible 161. The crucible 161 is inverted so as to retain the molten metal 162 which is less dense than the molten salt 130. This arrangement may be appropriate, for example, where the molten metal is liquid magnesium and the molten salt is calcium chloride.

The skilled person would be able to consult data charts to determine whether a particular molten metal is more or less dense than a particular molten salt in a combination used in an electrolysis reduction process. Thus, it is straightforward to determine whether or not an apparatus according to that illustrated in FIG. 1 or an apparatus according to that illustrated in FIG. 2 is most appropriate for conducting the reduction.

Although the illustrations of apparatus shown in FIGS. 1 and 2 show arrangements where a feedstock pellet is attached to a cathode, it is clear that other configurations are within the scope of the invention, for example, an oxide feedstock may be in the form of grains or powder and may be simply retained on the surface of a cathodic plate in an electrolysis cell.

The method of operating the apparatus will now be described in general terms with reference to FIG. 1. A cathode 40 comprising a metal oxide 50 and an anode 60 comprising a molten metal 62 are arranged in contact with a molten salt 30 within an electrolysis chamber 20 of an electrolysis cell 10. The oxide 50 comprises an oxide of a first metal. The molten metal is a second metal different from the first metal and is capable of being oxidised. A potential is applied between the anode and the cathode such that oxygen is removed from the metal oxide 50. This oxygen is transported from the metal oxide 50 towards the anode where it reacts with the molten metal 62 forming an oxide of the molten metal 62 and oxygen. The oxygen is therefore removed from the oxide 50 and retained within a second oxide of the molten metal. The parameters for operating such an electrolysis cell such that oxygen is removed are known through such processes as the FFC process. Preferably the potential is such that oxygen is removed from the metal oxide 50 and transported to the molten metal 62 of the anode without any substantial breakdown of the molten salt 30. As a result of the process the metal oxide 50 is converted to metal and the molten metal 62 is converted, as least in part, to a metal oxide. The metal product of the reduction can then be removed from the electrolysis cell.

The inventors have carried out a number of specific experiments based on this general method, and these are described below. The metal product produced in the examples was analysed using a number of techniques. The following techniques were used.

Carbon analysis was performed using an Eltra CS800 analyser.

Oxygen analysis was performed using an Eltra ON900 analyser.

Surface area was measured using a Micromeritics Tristar surface area analyser.

Particle size was measured using a Malvern Hydro 2000MU particle size determinator.

Experiment 1

Zinc used as the anode material was AnalaR Normapur® pellets supplied by VWR International Limited. Tantalum oxide was 99.99% purity and pressed and sintered to around 45% porosity. The powder supplier was F&X electrochemicals.

An 11 gram pellet of tantalum pentoxide 50 was connected to a tantalum rod 40 and used as a cathode. 250 grams of zinc 62 was contained in an alumina crucible 61 and connected to a power supply via a tantalum connecting rod 63 sheathed in a dense alumina tube 64. This construction was used as an anode 60. One kilogram of calcium chloride 30 was used as an electrolyte and contained within a large alumina crucible 20. The anode and pellet were arranged within the molten salt 30 and the temperature of the salt was raised to approximately 800° C.

The cell was operated in constant current mode. A constant current of 2 amps was applied between the anode and cathode for a period of 8 hours. During this time the potential between the anode and the cathode remained at roughly 1.5 volts.

There were no gases evolved at the anode during electrolysis. This was due to the formation of zinc oxide in the molten zinc anode 62. A total charge of 57700 coulombs was passed during the electrolysis reaction.

After a period of 8 hours the cathode and cathode pellet were removed and the cathode pellet 50 had been discovered to have reduced to tantalum metal. Analysis showed that the metal was contaminated with zinc. Oxygen analysis of the reduced product provided an average value of 2326 ppm, a carbon content of 723 ppm and the product had a surface area of 0.3697 meters squared per gram. Typical carbon contents of tantalum reduced in calcium chloride at this temperature using carbon anodes in the same experimental arrangement are 2000-3000 ppm. Considerable zinc dusting was observed in the cold parts of the reactor.

In order to remove the zinc contamination from the tantalum, the reduced product was placed in an alumina crucible and heated to 950° C. for 30 minutes under an argon atmosphere. After cooling the product was again examined in an SEM, it was found that the contaminating zinc had been removed from the reduced product leaving a tantalum powder.

It is believed that the overall reaction was $Ta_2O_5+5Zn=2Ta+5ZnO$. Thus, for a 46 gram $Ta_2O_5$ pellet, 34.03 grams of zinc should theoretically be consumed. At the cathode the reaction may be $Ta_2O_5+5e^-=2Ta=5O^{2-}$. The $O^{2-}$ may be transported through the molten electrolyte to the molten zinc anode. The reaction at the molten zinc anode may be $5Zn+5O^{2-}=5ZnO$. Zinc oxide is a solid at the temperatures of reduction. Zinc oxide formed at the surface is likely to become entrapped within the molten zinc in the alumina crucible and, therefore, free more molten zinc for reaction with further oxygen ions.

Experiment 2

Lithium chloride used in this experiment was standard lithium chloride 99% purity from Leverton Clarke. In a cell configuration as illustrated in FIG. 1, a 45 g pellet 50 of tantalum pentoxide was reduced in a lithium chloride salt for a period of 25 hours at 750° C. The cell was operated at a constant current of 4 amps. The product was analysed and found to have oxygen content of 2404 ppm, carbon content of 104 ppm and a surface area of 0.3135 meters squared per gram. Less zinc dusting in the cold parts of the reactor was evident compared to the experiment performed at 800° C.

The reduced product contained some zinc contamination. This contamination could be removed by employing the heating process described in experiment 1 above.

Experiment 3

A 45 g pellet of tantalum pentoxide was reduced in a lithium chloride molten salt using a molten zinc anode at a temperature of 650° C. A constant current of 4 amps was applied for a period of 30 hours and the Product contained 1619 ppm oxygen, 121 ppm carbon and a surface area of 0.6453 $m^2/g$. No gas evolution during electrolysis was measured by mass spectrometry. Even less zinc dusting in the cold parts of the reactor was evident compared to the experiment performed at 800° C. In contrast, tantalum oxide reduced at 650° C. in lithium chloride contained 1346 ppm carbon.

The reduced product contained some zinc contamination. This contamination could be removed by employing the heating process described in experiment 1 above.

Experiment 4

A 45 g pellet of tantalum pentoxide was reduced in a lithium chloride molten salt using a 200 g molten zinc anode at a temperature of 650° C. A constant current of 4 amps was applied for a period of 24 hours and the reduced product contained 2450 ppm oxygen, 9 ppm carbon and had a surface area of 0.6453 $m^2/g$. ICP-MS analysis of the product showed a Fe content of 93 ppm, which was the approximate level in the starting oxide. In contrast, tantalum pentoxide reduced in the same set-up but with carbon anodes that generate anodic gases typically contain 500-1000 ppm iron contamination originating from the metal components of the reactor that react with the anodic gases.

Experiment 5

A 28 g pellet of mixed titanium oxide, niobium oxide, zirconium oxide and tantalum oxide was prepared by wet mixing the powders, drying, pressing and sintering at 1000° C. for 2 hours. This was reduced in lithium chloride using a zinc anode at 650° C. by passing 295000 C of charge to produce an alloy Ti-23Nb-0.7Ta-2Zr containing 37000 ppm oxygen and 232 ppm carbon. No gases were evolved during electrolysis.

I claim:

1. A method for producing metal by electrolytic reduction of a feedstock comprising an oxide of a first metal, the method comprising the steps of, arranging the feedstock in contact with a cathode and a molten salt within an electrolysis cell, arranging an anode in contact with the molten salt within the electrolysis cell, the anode comprising a molten second metal, the second metal being different to the first metal, and applying a potential between the anode and the cathode such that oxygen is removed from the feedstock, the oxygen removed from the feedstock reacting with the molten second metal to form an oxide comprising the second metal such that substantially no gases are evolved at the anode during electrolysis.

2. The method according to claim 1, in which a proportion of the second metal is deposited at the cathode when the potential is applied such that the reduced feedstock comprises the first metal and a proportion of the second metal.

3. The method according to claim 2, comprising the further step of separating the second metal from the first metal to provide a product that comprises the first metal but not the second metal.

4. The method according to claim 3, in which the second metal is separated from the first metal by thermal treatment, such as thermal distillation.

5. The method according to claim 3, in which the second metal is removed from the first metal by treatment using an acid wash.

6. The method according to claim 1, in which the feedstock contains oxides of more than one different metal, and/or in which the first metal is an alloy.

7. The method according to claim 1, in which the second metal is an alloy, for example an alloy of eutectic composition.

8. The method according to claim 1, in which the second metal has a melting point of less than 1000 degrees centigrade and a boiling point of less than 1750 degrees centigrade.

9. The method according to claim 1, in which the first metal is, or is an alloy of, any metal selected from silicon, scandium, titanium, vanadium, chromium, manganese, iron, cobalt, nickel, germanium, yttrium, zirconium, niobium, molybdenum, hafnium, tantalum, tungsten, lanthanum, cerium, praseodymium, neodymium, samarium, actinium, thorium, protactinium, uranium, neptunium, or plutonium.

10. The method according to claim 1, in which the second metal is, or is an alloy of, any metal selected from zinc, tellurium, bismuth, lead, or magnesium.

11. The method according to claim 1, in which the molten salt is at a temperature below 1000 degrees centigrade when the potential is applied between the cathode and the anode.

12. The method according to claim 1, in which the molten salt is at a temperature below 850 degrees centigrade when the potential is applied between the cathode and the anode.

13. The method according to claim 1, in which the molten salt is at a temperature below 750 degrees centigrade when the potential is applied between the cathode and the anode.

14. The method according to claim 1, in which the molten salt is at a temperature below 650 degrees centigrade when the potential is applied between the cathode and the anode.

15. The method according to claim 1, in which the molten salt is a lithium bearing salt.

16. The method according to claim 15, in which the lithium bearing salt comprises lithium chloride.

17. The method according to claim 1, comprising a further step of reducing the oxide comprising the second metal to recover the second metal.

18. The method according to claim 17, in which the oxide comprising the second metal is transferred from the anode to a separate cell or chamber and reduced to recover the second metal, which is transferred back to the anode.

19. The method according to claim 1, in which the feedstock comprises a tantalum oxide and the anode comprises molten zinc.

20. The method according to claim 1, in which the feedstock comprises a titanium oxide and the anode comprises molten zinc.

21. The method according to claim 1, in which there is no carbon in contact with the molten salt within the electrolysis cell.

* * * * *